US011483652B2

(12) United States Patent
Ohashi

(10) Patent No.: US 11,483,652 B2
(45) Date of Patent: Oct. 25, 2022

(54) CONVERSATION SUPPORT DEVICE

(71) Applicant: Panasonic Intellectual Property Management Co., Ltd., Osaka (JP)

(72) Inventor: Hiromasa Ohashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/023,924

(22) Filed: Sep. 17, 2020

(65) Prior Publication Data

US 2021/0006900 A1 Jan. 7, 2021

Related U.S. Application Data

(63) Continuation of application No. PCT/JP2019/010723, filed on Mar. 15, 2019.

(30) Foreign Application Priority Data

Mar. 19, 2018 (JP) ..... JP2018-050337

(51) Int. Cl.
*H04R 3/02* (2006.01)
*G10K 11/178* (2006.01)
*G10L 21/0208* (2013.01)

(52) U.S. Cl.
CPC ..... *H04R 3/02* (2013.01); *G10K 11/178* (2013.01); *G10L 21/0208* (2013.01)

(58) Field of Classification Search
CPC .. H04R 3/02; G10K 11/178; G10K 2210/128; G10K 2210/1282; G10L 21/0208; H04M 9/082
See application file for complete search history.

(56) References Cited

U.S. PATENT DOCUMENTS 4,677,676 A * 6/1987 Eriksson ..... G10K 11/1785 381/71.11
5,033,082 A * 7/1991 Eriksson ..... G10K 11/17881 379/406.08

(Continued)

FOREIGN PATENT DOCUMENTS

JP 5-035284 2/1993
JP 2003-124849 4/2003

(Continued)

OTHER PUBLICATIONS

Glentis et al., "Efficient least squares adaptive algorithms for FIR transversal filtering", Jul. 1999, IEEE Signal Processing Magazine, vol. 16, No. 4, pp. 13-41. (Year: 1999).*

(Continued)

*Primary Examiner* — Daniel R Sellers
(74) *Attorney, Agent, or Firm* — Wenderoth, Lind & Ponack, L.L.P.

(57) ABSTRACT

A conversation support device includes: a speaker; a microphone; a noise source acquisition unit that acquires a noise signal indicating noise; a first calculator that calculates a transfer characteristic of a secondary path between the speaker and the microphone; an echo cancellation unit that cancels an echo by using the transfer characteristic of the secondary path; a second calculator that calculates a coefficient of an adaptive filter, based on the transfer characteristic of the secondary path and the noise signal; and an active noise cancellation controller that generates a noise cancelling signal by using the coefficient of the adaptive filter and the noise signal. The noise cancelling signal is for controlling cancellation of the noise.

8 Claims, 10 Drawing Sheets

(56) References Cited

U.S. PATENT DOCUMENTS

| | | | | |
|---|---|---|---|---|
| 6,496,581 | B1 * | 12/2002 | Finn | H04M 9/082 379/406.01 |
| 2005/0207585 | A1 * | 9/2005 | Christoph | G10K 11/17883 381/71.11 |
| 2008/0240457 | A1 | 10/2008 | Inoue et al. | |
| 2010/0074434 | A1 | 3/2010 | Kobayashi | |
| 2018/0115650 | A1 | 4/2018 | Suzuki et al. | |
| 2019/0130930 | A1 * | 5/2019 | Tong | H04R 1/1083 |

FOREIGN PATENT DOCUMENTS

| | | |
|---|---|---|
| JP | 2008-247342 | 10/2008 |
| JP | 2010-81004 | 4/2010 |
| WO | 2017/064839 | 4/2017 |

OTHER PUBLICATIONS

International Search Report dated Jun. 11, 2019 in corresponding International Application No. PCT/JP2019/010723.

* cited by examiner

CONVERSATION SUPPORT DEVICE

TECHNICAL FIELD

The present disclosure relates to a conversation support device that cancels noise at a talker's location in an environment where noise interferes with a voice to be listened to.

BACKGROUND ART

PTL 1 discloses a two-way conversation assist device that achieves support of two-way conversations between talkers by using a microphone and a speaker provided in a vehicle room. This two-way conversation assist device is a two-way conversation assist device that amplifies and thus assists two-way conversations between a first talker and a second talker. The two-way conversation assist device includes: a first microphone that receives a first voice of the first talker; a first speaker that outputs the first voice; a second microphone that receives a second voice of the second talker; a second speaker that outputs the second voice; and an echo crosstalk canceller. The echo crosstalk canceller uses an input signal for the second speaker to calculate an estimated value of an interference signal. This interference signal indicates the level of a first echo of the second voice that has been output from the second speaker and received by the first microphone and the level of crosstalk of the second voice that has been received by the first microphone. Then, the echo crosstalk canceller removes the calculated, estimated value of the interference signal from a signal output from the first microphone.

PTL 2 discloses an active noise cancellation device that cancels vehicular room inner noise in a vehicular inner space, the vehicular room inner noise containing road noise and engine noise inside a vehicle room. This active noise cancellation device includes: a controller that generates a cancellation sound that spatially cancels noise inside the vehicle room; a speaker that outputs the cancellation sound to cancel the noise; and an error detection microphone that detects a cancellation error sound made by the noise and the cancellation sound.

Based on a correction value related to transfer characteristics between the cancellation sound output speaker and the error detection microphone that have been identified in advance, the controller includes an echo canceller that generates an echo cancellation signal to cancel the cancellation sound reproduced by the cancellation sound speaker from the cancellation error sound detected by the error detection microphone.

CITATION LIST

Patent Literature

PTL 1: WO2017-064839

PTL 2: Unexamined Japanese Patent Publication No. 2008-247342

SUMMARY

The present disclosure provides a conversation support device that, even if a sound transfer path changes between a microphone and a speaker due to changes in surrounding environment, achieves active noise cancellation by following the changes.

A conversation support device according to the present disclosure includes: a speaker; a microphone; a noise source acquisition unit that acquires a noise signal indicating noise; a first calculator that calculates a transfer characteristic of a secondary path between the speaker and the microphone; an echo cancellation unit that cancels an echo by using the transfer characteristic of the secondary path; a second calculator that calculates a coefficient of an adaptive filter, based on the transfer characteristic of the secondary path and the noise signal; and an active noise cancellation controller that generates a noise cancelling signal by using the coefficient of the adaptive filter and the noise signal. The noise cancelling signal is for controlling cancellation of the noise.

A conversation support device according to the present disclosure, even if environment changes between a microphone and a speaker, can achieve active noise cancellation by following the changes.

DESCRIPTION OF EMBODIMENTS

Some exemplary embodiments will be described below in detail with reference to the drawings as appropriate. In some instances, excessively detailed descriptions will be skipped. For example, detailed descriptions of known matters and duplicate descriptions of substantially identical configurations may be skipped. A reason for this is to avoid unnecessary redundancy of the following description and to facilitate understanding of those skilled in the art.

It should be noted that the accompanying drawings and the following description are provided to help those skilled in the art fully understand the present disclosure and not intended to limit subject matters as described in the claims.

Figure 1:
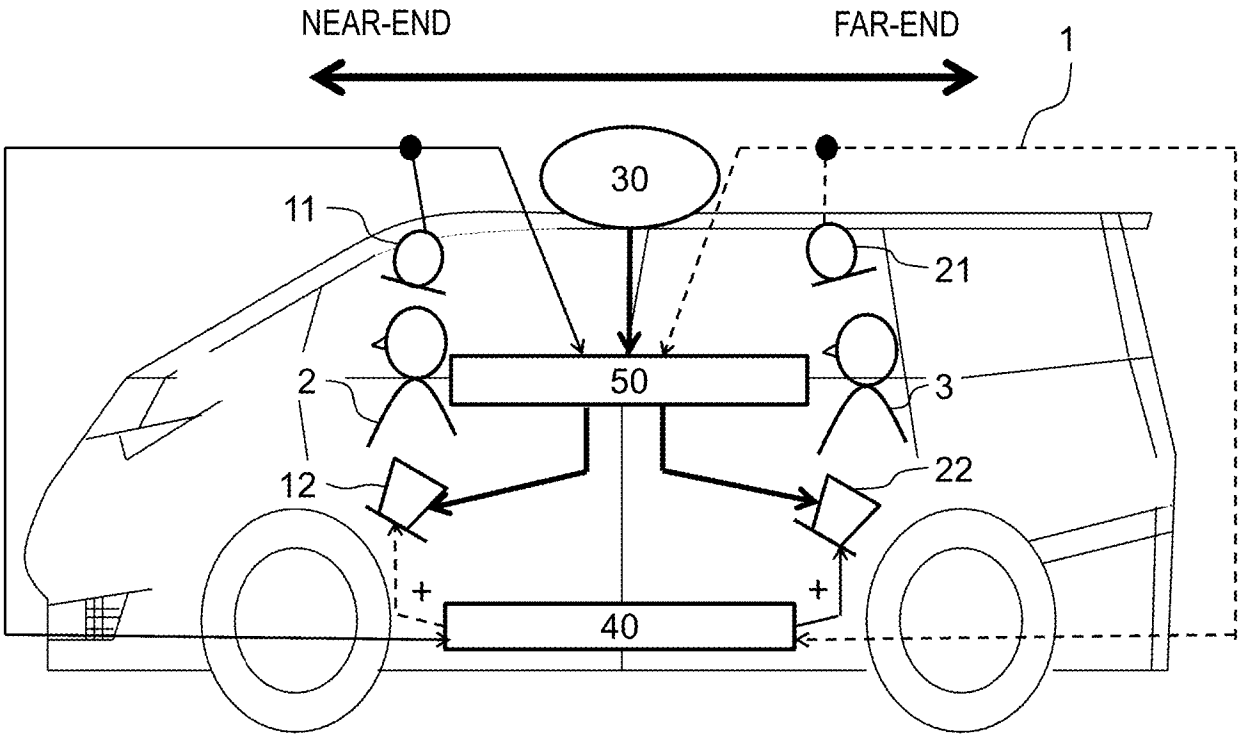
FIG. 1 is a schematic diagram of a conversation support device that includes an echo cancellation device and an active noise control device, according to the present disclosure.
Figure 2:
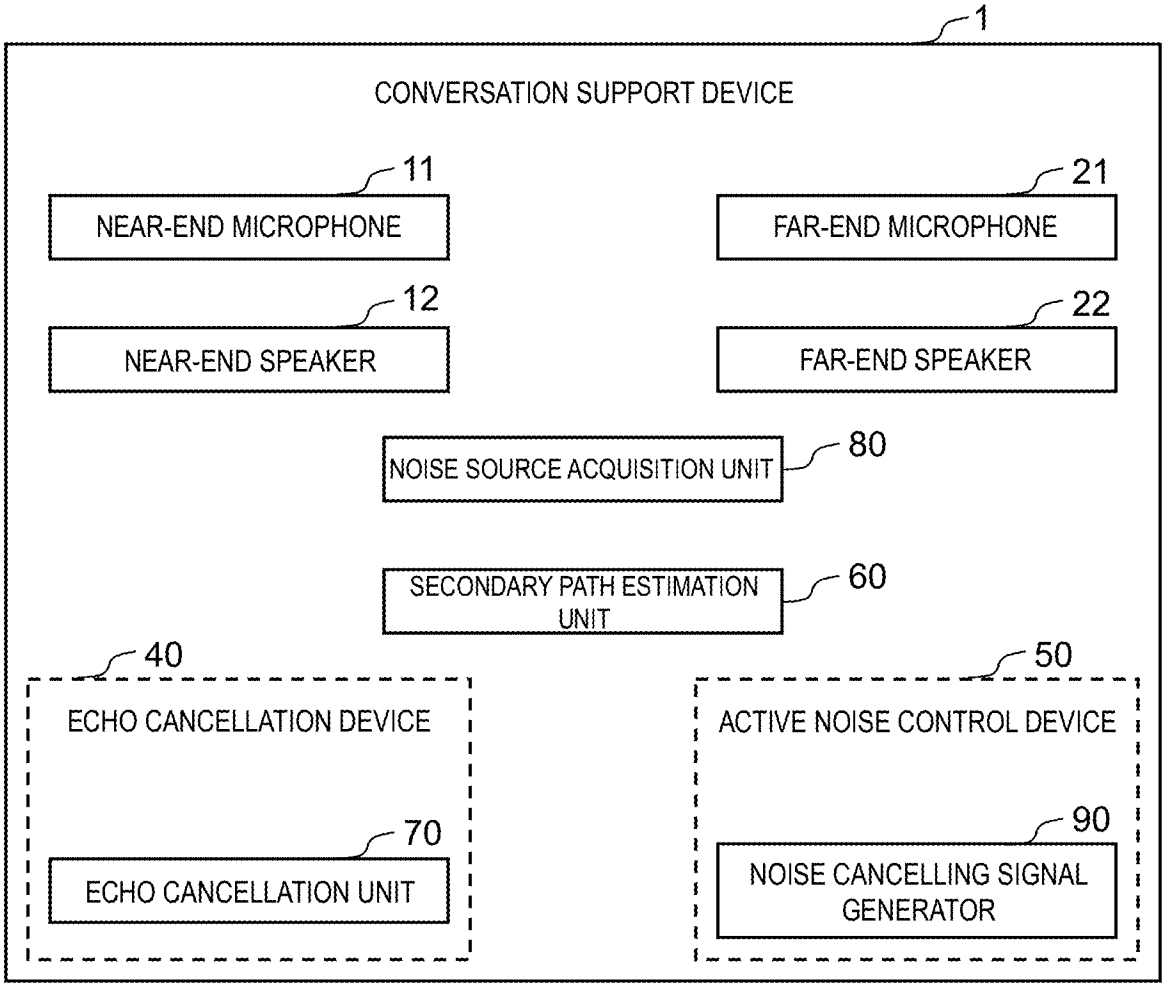
FIG. 2 is a configuration diagram illustrating a configuration of the conversation support device that includes the echo cancellation device and the active noise control device, according to the present disclosure.

With reference to FIGS. 1 and 2, a configuration of conversation support device 1 according to the present disclosure will be described below.

FIG. 1 is a configuration diagram of conversation support device 1 that includes echo cancellation device 40 and active noise control device 50, according to the present disclosure. In the present disclosure, an automobile will be described as an application example of conversation support device 1. In short, conversation support device 1 is provided in a vehicle such as an automobile.

Conversation support device 1 according to the present disclosure includes near-end microphone 11, far-end microphone 21, near-end speaker 12, far-end speaker 22, echo cancellation device 40, and active noise control device 50.

Near-end microphone 11 picks up a speech of near-end talker 2 and simultaneously monitors noise coming from noise source 30 toward near-end talker 2. For that purpose, near-end microphone 11 serves both as a sound pickup microphone that picks up the speech of near-end talker 2 and as an error microphone that monitors an error between noise around near-end talker 2 and noise cancelation sound generated and reproduced by active noise control device 50.

Far-end microphone 21 picks up a speech of far-end talker 3 and simultaneously monitors noise coming from noise source 30 toward far-end talker 3. For that purpose, far-end microphone 21 serves both as a sound pickup microphone that picks up the speech of far-end talker 3 and an error microphone that monitors an error between noise around far-end talker 3 and as the noise cancelation sound generated and reproduced by active noise control device 50.

Near-end speaker 12 amplifies and outputs the speech of far-end talker 3 and simultaneously reproduces a signal to clear noise around near-end talker 2. For that purpose, near-end speaker 12 serves both as a loudspeaker that amplifies and outputs the speech of far-end talker 3 and as a clearing speaker that clears noise around near-end talker 2. Specifically, near-end speaker 12 is electrically connected to far end microphone 21 and outputs a sound based on an input to far-end microphone 21.

Far-end speaker 22 amplifies and outputs the speech of near-end talker 2 and simultaneously reproduces a signal to clear noise around far-end talker 3. For that purpose, far-end speaker 22 serves both as a loudspeaker that amplifies and outputs the speech of near-end talker 2 and a clearing speaker that clears noise around far-end talker 3. Specifically, far-end speaker 22 is electrically connected to near-end microphone 11 and outputs a sound based on an input to near-end microphone 11.

A near-end refers to a near side in a running direction of a vehicle body, and indicates, for example, a driver seat side or a passenger seat side. Afar-end refers to a far side in the running direction of the vehicle body and indicates, for example, a rear seat row side.

Echo cancellation device 40 removes an incoming echo signal from a signal picked up by near-end microphone 11; the incoming echo signal is generated as a result of a sound signal reproduced by near-end speaker 12, propagating through space, and reaching near-end microphone 11. Moreover, echo cancellation device 40 also removes another incoming echo signal from a signal picked up by far-end microphone 21; the incoming echo signal is generated as a result of a sound signal reproduced by far-end speaker 22, propagating through space, and reaching far end microphone 21.

Active noise control device 50 uses a noise signal around near-end talker 2 monitored by near-end microphone 11 and a noise signal of noise source 30 acquired by independent means to generate a noise cancelling signal for use in controlling the amount of noise around near-end talker 2. Likewise, active noise control device 50 uses a noise signal around far-end talker 3 monitored by far-end microphone 21 and a noise signal of noise source 30 acquired by independent means to generate a noise cancelling signal for use in controlling the amount of noise around far end talker 3.

Regarding a flow from the near-end to the far-end in conversation support device 1, the speech of near-end talker 2 picked up by near-end microphone 11 is supplied to echo cancellation device 40. Then, the speech signal from which an unwanted incoming echo signal is removed is amplified and output from far-end speaker 22 toward far-end talker 3. This achieves support of a conversation from near-end talker 2 to far-end talker 3 inside a vehicle room.

On the far-end, conversation support device 1 amplifies and outputs the speech of near-end talker 2. As a result, even if a speech of near-end talker 2 is difficult to listen to in an environment where noise occurs during running, for example, it is possible to improve listening to the voice of near-end talker 2.

In the above case, active noise control device 50 cancels noise at a listening location on the far-end in addition to assisting the listening to a voice by amplifying and outputting the voice with conversation support device 1. Therefore, it is possible to improve support of two-way conversations.

FIG. 2 is a diagram illustrating a configuration of conversation support device 1 according to the present disclosure. Conversation support device 1 includes near-end microphone 11, near-end speaker 12, far-end microphone 21, far-end speaker 22, secondary path estimation unit 60, echo cancellation device 40, noise source acquisition unit 80, and active noise control device 50. Echo cancellation device 40 includes echo cancellation unit 70. Active noise control device 50 includes noise cancelling signal generator 90. Some or all of noise source acquisition unit 80, secondary path estimation unit 60, echo cancellation device 40, and active noise control device 50 may be implemented by one or more integrated circuits (ICs). In addition, some or all of noise source acquisition unit 80, secondary path estimation unit 60, echo cancellation device 40, and active noise control device 50 may be implemented by a processor provided in conversation support device 1 executing a program stored in a memory provided in conversation support device 1.

On the near-end, secondary path estimation unit 60 estimates secondary path information by using an echo-cancelled signal, which is a signal from which an echo of near-end microphone 11 has been cancelled, and the signal amplified by and output from near-end speaker 12. Likewise, on the far-end, secondary path estimation unit 60 estimates secondary path information by using an echo-cancelled signal, which is a signal from which an echo of far-end microphone 21 has been cancelled and the signal amplified by and output from far-end speaker 22. In this case, the secondary path information on the near-end refers to transfer characteristics of a space through which a signal output from near-end speaker 12 is transmitted to near-end microphone 11. The secondary path information on the far-end refers to transfer characteristics of a space through which a signal output from far-end speaker 22 is transmitted to far-end microphone 21.

Regarding echo cancellation device 40 and active noise control device 50, a sound picked up by near-end microphone 11 is targeted and the description will be given below. However, the same description can be true of far-end microphone 21.

Echo cancellation unit 70 is provided in echo cancellation device 40. Echo cancellation unit 70 receives a sound pickup signal, which is a signal of a sound picked up by near-end microphone 11 and generates a pseudo echo signal to cancel an echo signal. Then, echo cancellation unit 70 subtracts the generated pseudo echo signal from the sound pickup signal, thereby canceling the echo signal. In this case, the echo signal refers to a signal of a sound that has been amplified by and output from near-end speaker 12 and picked up by near-end microphone 11.

Echo cancellation unit 70 generates the pseudo echo signal by using an output signal output from near-end speaker 12 and the secondary path information. In short, echo cancellation unit 70 generates the pseudo echo signal by receiving the secondary path information.

The echo-cancelled signal in which the echo signal has been cancelled by echo cancellation unit 70 is added to a noise cancelling signal generated by active noise control device 50 independently provided on the far-end and is reproduced by far-end speaker 22.

Noise source acquisition unit 80 acquires a noise signal representative of the noise of noise source 30. For example, if noise source 30 is rotational noise of an engine, an external microphone may be disposed near the engine. Noise source acquisition unit 80 thereby can acquire the rotational noise of the engine as a noise signal. Alternatively, noise source acquisition unit 80 may acquire a pulse wave of the engine as the noise signal. The above external microphone is typically called a reference microphone or a noise reference microphone.

If noise source 30 is noise generated between a road and a tire, the external microphone may be disposed near the tire. Noise source acquisition unit 80 thereby can acquire the noise signal. Noise source acquisition unit 80 is implemented by an independent structure named by noise source acquisition unit 80; however, noise source acquisition unit 80 may be provided in near-end microphone 11 or in far-end microphone 21.

Noise cancelling signal generator 90 generates the noise cancelling signal to control noise around near-end talker 2. Then, noise cancelling signal generator 90 adds the generated noise cancelling signal to a signal to be reproduced by near-end speaker 12, which amplifies and outputs the signal generated by the addition. In this way, it is possible to control noise around near-end microphone 11. Furthermore, the noise cancelling signal is estimated as a signal for use in spatially canceling noise propagating from a place where noise has occurred toward near-end talker 2. In short, the noise cancelling signal refers to a signal used for active noise control (ANC).

To generate the noise cancelling signal, noise cancelling signal generator 90 needs the noise signal acquired by noise source acquisition unit 80, an error signal for use in measuring a noise cancellation amount in a control space around near-end talker 2, and the secondary path information. In this case, the error signal is acquired by monitoring, through near-end microphone 11, how much the noise signal around near-end talker 2 is spatially cancelled by the noise cancelling signal that near-end speaker 12 has reproduced. The secondary path information refers to information indicating how the noise cancelling signal reproduced by near-end speaker 12 varies at a location where noise source 30 is monitored.

A signal monitored by near-end microphone 11, however, may contain an echo signal, such as a speech of far-end talker 3 reproduced by near-end speaker 12. Thus, active noise control device 50 needs to use, as the error signal, the echo-cancelled signal in which echo cancellation unit 70 has cleared the echo signal. Furthermore, the secondary path information is acquired by the secondary path information that has been estimated by secondary path estimation unit 60 and then supplied to noise cancelling signal generator 90.

As described above, noise cancelling signal generator 90 generates the noise cancelling signal by using the noise signal, the error signal, and the secondary path information.

First Exemplary Embodiment

With reference to FIGS. 3 to 6, a process in conversation support device 1 according to a first exemplary embodiment will be described below.

[1-1. Process in Conversation Support Device]

Figure 3:
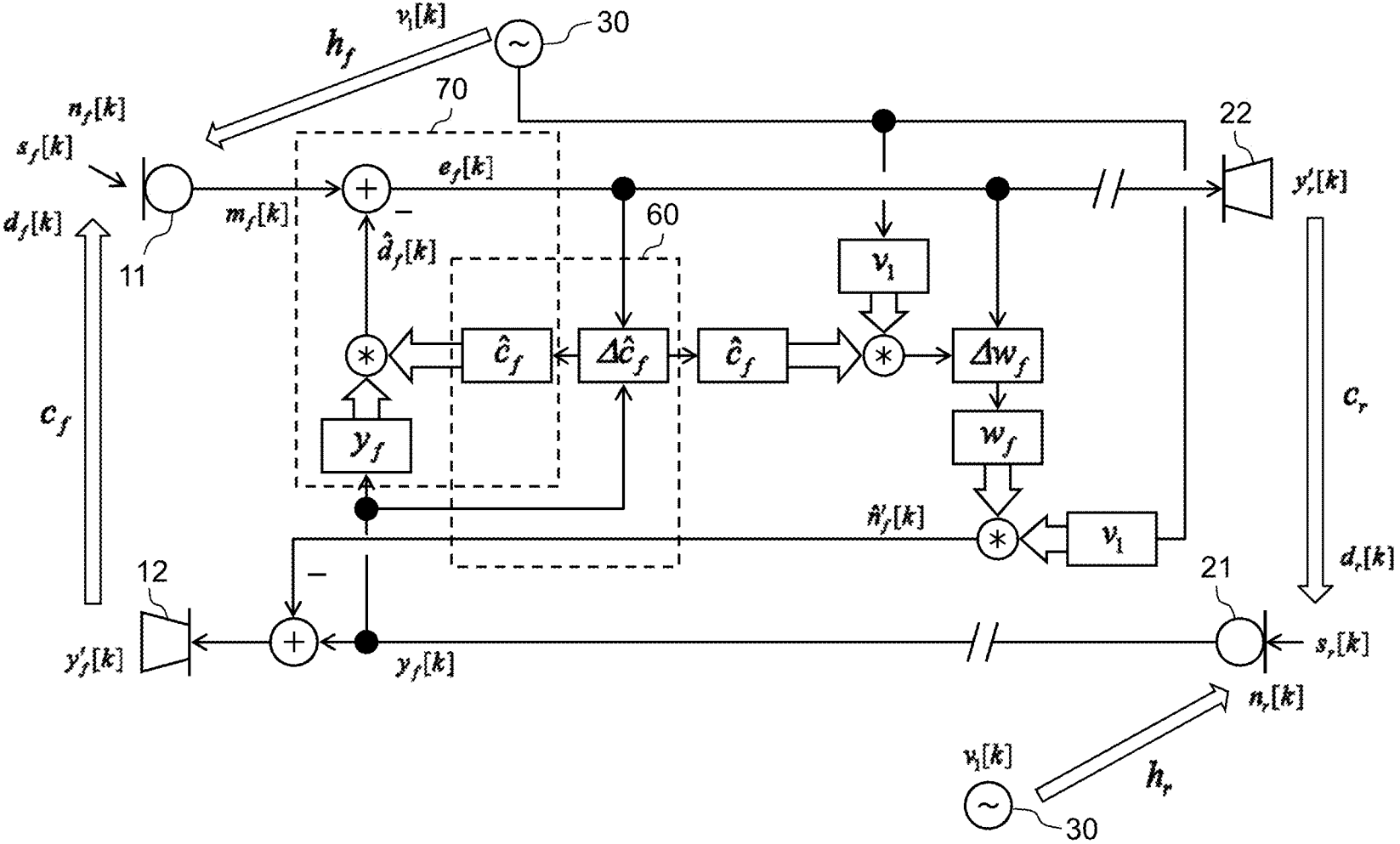
FIG. 3 is a block diagram of a configuration of a conversation support device according to a first exemplary embodiment.

FIG. 3 is a block diagram of the conversation support device according to the first exemplary embodiment.

Here, the near-end is denoted by a subscript f, and the far-end is denoted by a subscript r. In addition, a discrete-time index denotes by k. Symbols expressed in bold type in equations denote vectors and represent time-series signal vectors or coefficient vectors related to the time-series.

In the present exemplary embodiment, an operation on the near-end will be described as an example; however, the same operation may be performed on both of the near-end and the far-end.

A microphone (input) signal $m_f[k]$ picked up by near-end microphone 11 is expressed by equation 1, which is equivalent to a sum of a voice signal $s_f[k]$ indicating, for example, a speech of near-end talker 2, an incoming echo signal $d_f[k]$, and a noise signal $n_f[k]$.

$$m_f[k]=s_f[k]+d_f[k]+n_f[k] \tag{1}$$

The incoming echo signal $d_f[k]$ is acquired, as expressed by equation 2, by convolving secondary path information $c_f$ into a time-series signal $y_f$ of a reproduction signal $y_f[k]$ of near-end speaker 12 before addition of a clear signal. The secondary path information $c_f$ refers to path information in which a spatial transfer characteristic from near-end speaker 12 to near-end microphone 11 is expressed as a finite impulse response (FIR) filter of a finite length.

$$d_f[k]=c_f * \mathbf{y}_{f^{*i}} \tag{2}$$

In this equation, * denotes a convolution operation.

The secondary path information $c_f$ refers to a transfer characteristic of a secondary path as seen from active noise control device 50 of a feedforward type. The feedforward type refers to a control operation by which noise is cleared before the noise exerts influence. The secondary path includes transfer paths of a direct sound and a reflected sound. More specifically, the secondary path refers to paths along which a sound wave output from a speaker propagates to a microphone through the air.

The incoming noise signal $n_f[k]$ is acquired by convolving primary path information $h_f$ into a time-series signal $v_1$ of $v_1[k]$ indicating noise source 30, as expressed by equation 3. The primary path information $h_f$ refers to path information in which a spatial transfer characteristic from a location of a noise source to near-end microphone 11 is expressed as an FIR filter of a finite length.

$$n_f[k]=h_f * \mathbf{y}_{f^{*i}} \tag{3}$$

A subscript 1 of v denoting noise source 30 represents a first noise source out of a plurality of noise sources assumed to be present. The primary path information $h_f$ refers to a transfer characteristic of a primary path as seen from active noise control device 50 of the feedforward type.

As described above, the echo signal $d_f[k]$ coming from near-end speaker 12 and the incoming noise signal $n_f[k]$ coming from noise source 30 are superimposed on the microphone signal $m_f[k]$. Conversation support device 1 needs to transmit only the speech $s_f[k]$ of near-end talker 2 to far-end talker 3 by canceling the mixed incoming echo signal $d_f[k]$.

Active noise control device 50 needs to generate the noise cancelling signal to spatially cancel the noise by using the echo-cancelled signal in which the mixed echo signal has been cancelled and the secondary path acquired at the time of canceling the echo.

To accomplish the above object, the process is performed in accordance with the following flow in the present disclosure.

First, echo cancellation unit 70 removes the echo signal $d_f[k]$ from the microphone signal $m_f[k]$.

When removing the echo signal, echo cancellation unit 70 generates a pseudo echo signal $\hat{d}_f[k]$ for use in removing the echo signal $d_f[k]$.

Next, secondary path estimation unit 60 estimates the secondary path information $c_f$ as secondary path information $\hat{c}_f$ in order to generate the pseudo echo signal $\hat{d}_f[k]$. For example, secondary path estimation unit 60 calculates the secondary path information $\hat{c}_f$ (a transfer characteristic of the secondary path) based on an input to near-end microphone 11 and an output from near-end speaker 12. A specific method of canceling the incoming echo signal $d_f[k]$ will be described later with reference to FIG. 4.

An echo-cancelled signal $e_f[k]$ is acquired by subtracting the acquired pseudo echo signal $\hat{d}_f[k]$ from the microphone signal $m_f[k]$, as expressed by equation 4.

$$e_f[k]=m_f[k]-\hat{d}_f[k]=s_f[k]+(d_f[k]-\hat{d}_f[k])+n_f[k] \tag{4}$$

The pseudo echo signal $\hat{d}_f[k]$ is expressed by equation 5.

$$\hat{d}_f[k]=\hat{c}_f^{*}\,\mathbf{y}_{f}^{*} \tag{5}$$

The pseudo echo signal $\hat{d}_f[k]$ is a signal generated by convolving the secondary path information $\hat{c}_f$ estimated by secondary path estimation unit 60 into the signal reproduced by near-end speaker 12.

It can be understood that echo cancellation is achieved when the incoming echo signal $d_f[k]$ equates with the pseudo echo signal $\hat{d}_f[k]$.

Next, noise cancelling signal generator 90 generates a noise cancelling signal $\hat{n}'_f[k]$ to spatially control and cancel noise by using the noise signal acquired from noise source acquisition unit 80, the echo-cancelled signal $e_f[k]$ in which the incoming echo signal has been cancelled, and the secondary path information $\hat{c}_f$ estimated by secondary path estimation unit 60.

By using the secondary path information $\hat{c}_f$ estimated by secondary path estimation unit 60, noise cancelling signal generator 90 can achieve the active noise control stably even if the secondary path changes.

It should be noted that the noise cancelling signal of noise cancelling signal generator 90 will be described concretely later with reference to FIG. 5.

The acquired noise cancelling signal $\hat{n}'_f[k]$ is subtracted from the reproduced signal $y_f[k]$ reproduced by near-end speaker 12 to provide a reproduction signal $y'_f[k](=y_f[k]-\hat{n}'_f[k])$.

When near-end speaker 12 reproduces the time-series signal $y'_f$ of the reproduction signal $y'_f[k]$, $d'_f[k]$ is represented by equation 6.

$$d'_f[k]=c_f^{*}y'_k=c_f^{*}(y_k-\hat{n}'_f)=d_f[k]-\hat{n}_f[k] \tag{6}$$

In this equation, the cancellation noise signal $\hat{n}_f[k]$ is expressed by equation 7.

$$\hat{n}_f[k]=c_f^{*}\,\hat{\mathbf{n}}'_{f}{}^{*} \tag{7}$$

When the secondary path information $c_f$ is convoluted into the noise cancelling signal $\hat{n}'_f[k]$, a cancellation noise signal $\hat{n}_f[k]$ for use in canceling noise at the location of near-end microphone 11 is acquired. Then, when near-end speaker 12 outputs the cancellation noise signal $\hat{n}_f[k]$, equation 1 is modified into equation 8.

$$m_f[k]=s_f[k]+d'_f[k]+n_f[k]=s_f[k]+d_f[k]+(n_f[k]-\hat{n}_f[k]) \tag{8}$$

By using the expression of equation 8, equation 4 is modified into equation 9.

$$e_f[k]=m_f[k]-\hat{d}_f[k]=s_f[k]+(d_f[k]-\hat{d}_f[k])+(n_f[k]-\hat{n}_f[k]) \tag{9}$$

In any of equations 8 and 9, when the incoming noise signal $n_f[k]$ equates with the cancellation noise signal $\hat{n}_f[k]$ generated by convoluting the noise cancelling signal $\hat{n}'_f[k]$ into the secondary path information $c_f$, noise cancellation is achieved.

Unlike the echo cancellation, the noise cancellation operation is achieved, rather than by signal processing, by actually outputting the noise cancelling signal from the speaker and spatially adding the noise cancelling signal. Therefore, the noise cancellation operation is further effective at the location of the microphone in space.

As described above, conversation support device 1 can simultaneously achieve both spatial noise cancellation by outputting a noise cancelling signal from a speaker to a pickup microphone signal and echo cancellation by subjecting a noise-cancelled signal to an echo canceller. Near-end microphone 11 acquires the microphone signal $m_f[k]$ (input signal). Echo cancellation unit 70 generates the pseudo echo signal $\hat{d}_f[k]$ (cancellation signal) by using the transfer characteristic $\hat{c}_f$ of the secondary path. Noise cancelling signal generator 90 generates an echo-cancelled signal $e_f[k]$ (output signal), based on the microphone signal $m_f[k]$, the pseudo echo signal $\hat{d}_f[k]$, and the noise cancelling signal $\hat{n}'_f[k]$. Near-end speaker 12 outputs a sound based on the echo-cancelled signal $e_f[k]$.

If the echo cancellation and the noise cancellation are ideally achieved in equation 9, equation 9 is expressed by equation 10. In this case, only the voice signal $s_f[k]$, which represents the speech of near-end talker 2, or an originally pickup target, is passed.

$$e_f[k]=s_f[k]+(d_f[k]-\hat{d}_f[k])+(n_f[k]-\hat{n}_f[k])\rightarrow s_f[k] \tag{10}$$

It should be noted that the above configuration is also applicable to far-end microphone 21 and far-end speaker 22. However, this configuration is omitted in FIG. 3 in order to simplify the configuration of FIG. 3 such that those skilled in the art can understand the configuration easily.

[1-2. Processing in Secondary Path Estimation Unit 60 and Echo Cancellation Unit 70 in Conversation Support Device]

Figure 4:
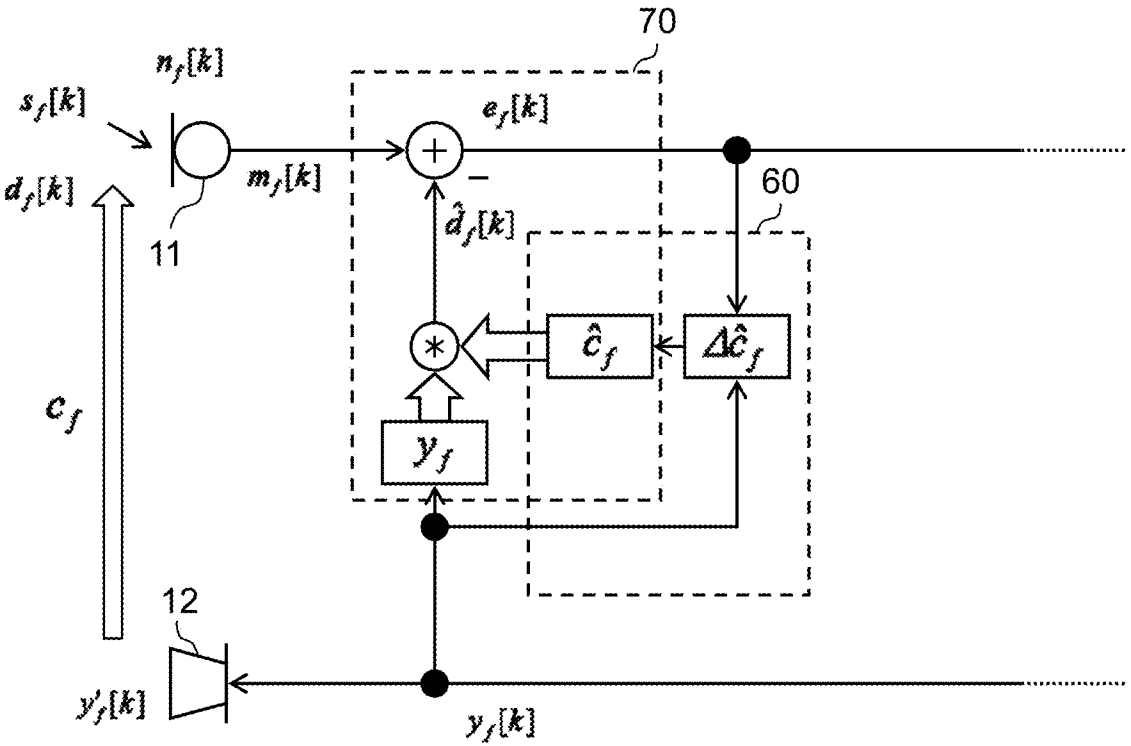
FIG. 4 is a block diagram illustrating configurations of an echo cancellation unit and a secondary path estimation unit in the conversation support device according to the first exemplary embodiment.

FIG. 4 is a block diagram illustrating configurations of secondary path estimation unit 60 and echo cancellation unit 70 according to the first exemplary embodiment.

Echo cancellation unit 70 performs the echo cancellation in accordance with equation 4. By substituting equation 2 and equation 5 into equation 4, the echo-cancelled signal $e_f[k]$ is expressed by equation 11.

$$e_f[k]=s_f[k]+(c_f*y_f-\hat{c}_f*y_f)+n_f[k]=s_f[k]+(c_f-\hat{c}_f)*y_f+n_f[k] \quad (11)$$

To achieve the echo cancellation, it is necessary to equate the secondary path information $c_f$, which is the transfer characteristic of the space, with the secondary path information $\hat{c}_f$ estimated as an adaptive filter.

The secondary path information $\hat{c}_f$ is estimated by secondary path estimation unit 60. Secondary path estimation unit 60 estimates the secondary path information $\hat{c}_f$ as an adaptive filter by a sequential update formula as in equation 12.

$$\hat{c}_f^{(k)}=\hat{c}_f^{(k-1)}+\mu\Delta\hat{c}_f^{(k)} \quad (12)$$

In this equation, $\hat{c}^{(k)}_f$ is an adaptive filter estimated at time k. In this case, $\hat{c}^{(k)}_f$ is updated by adding a value proportional to the adaptive filter update amount $\Delta\hat{c}_f$ to the adaptive filter one time before. Furthermore, μ is a step parameter for use in controlling an update amount for each update and is typically a value that attenuates in accordance with taps of the adaptive filter.

Methods of determining $\Delta\hat{c}_f$ typically include a least mean square (LMS) method, a learning identification (NLMS) method, and a time-domain independent component analysis (ICA). In any of the methods, $\Delta\hat{c}_f$ can be determined by reflecting the amount of echo cleared by the echo-cancelled signal $e_f[k]$ and referring to the speaker signal $y_f[k]$, which is a source of the incoming echo signal, as expressed by equation 13.

$$\Delta\hat{c}_f^{(k)}[l]=\frac{e_f[k]y_f[k-l]}{N_f[k]}. \quad \text{[Equation 13]}$$

In this equation, l denotes an index representative of an l-th tap in the adaptive filter.

$N_f[k]$ denotes a norm signal for use in normalizing the update amount. As $N_f[k]$, for example, reference signal power in a certain time past from a current time k is used. Further, in equation 13, the error signal $e_f[k]$ is multiplied as it is, but in the time domain ICA, a value which is nonlinearly converted by the sign function or the tanh function is used. As an adaptive filter estimation method, an adaptive filter estimation method that uses samples over a plurality of times, such as an affine projection (APA) method or a recursive least squares (RLS) method, may be used.

The update amount $\Delta\hat{c}_f$ calculated by equation 13 is added to the adaptive filter $\hat{c}^{(k)}_f$ by secondary path estimation unit 60, as in equation 12. The adaptive filter $\hat{c}^{(k)}_f$ calculated in this manner is convolved into the speaker signal $y_f$ in echo cancellation unit 70, so that the echo cancellation is achieved.

[1-3. Processing of Active Noise Cancelling Signal Generator in Conversation Support Device]

Figure 5:
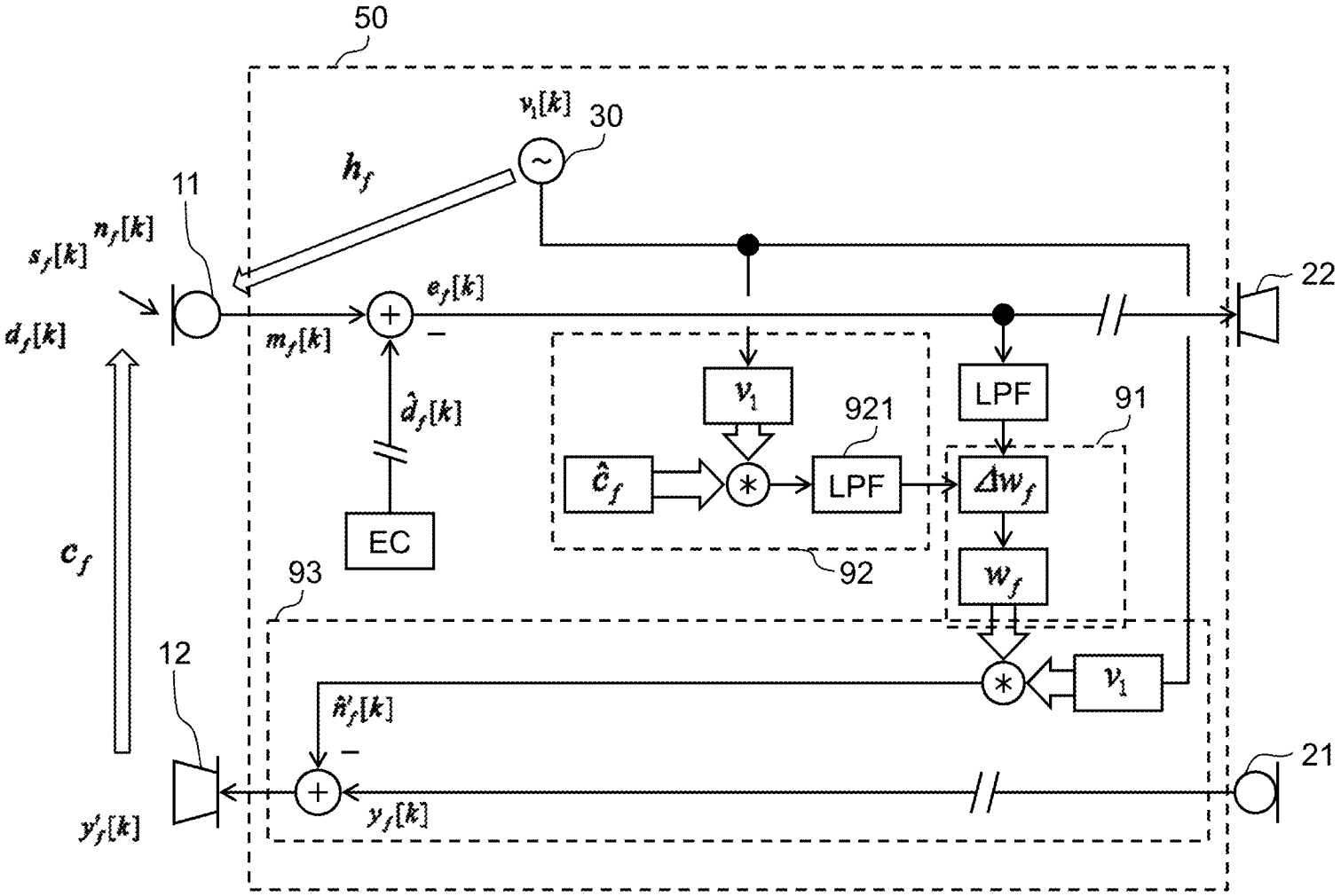
FIG. 5 is a block diagram illustrating a configuration of an noise cancelling signal generator in the conversation support device according to the first exemplary embodiment.

FIG. 5 is a block diagram illustrating a configuration of noise cancelling signal generator 90 in the first exemplary embodiment. Note that, in FIG. 5, secondary path estimation unit 60 and echo cancellation unit 70 described in the detailed block diagrams illustrated in FIGS. 3 and 4 are omitted.

Noise cancelling signal generator 90 includes reference signal generator 91, adaptive filter estimation unit 92, and noise cancelling signal generator 93.

In the first exemplary embodiment, as a precondition, the feedforward type of active noise control device 50 updates a filtered-x type of adaptive filter. However, it is also possible to achieve a feedback type of active noise control with a similar configuration.

As described with equation 8, active noise control device 50 reproduces an internally generated noise cancelling signal with a loud speaker, thereby achieving the spatial noise cancellation at the location of near-end microphone 11. Active noise control device 50 internally estimates a coefficient $w_f$ of the adaptive filter in order to generate the noise cancelling signal. Noise cancelling signal generator 93 convolves the internally estimated adaptive filter coefficient $w_f$ into the time-series signal $v_1$ of the noise signal $v_1[k]$ acquired by noise source acquisition unit 80, thereby generating the noise cancelling signal $\hat{n}'_f[k]$ in accordance with equation 14.

$$\hat{n}'_f[k]=w_f*\mathbf{v_1} \quad (14)$$

The coefficient $w_f$ of the adaptive filter is a coefficient for use in cancelling a noise signal that has been transmitted from a location of a noise source to a microphone through primary path information $h_f$, in consideration of an influence of the secondary path information $c_f$. The adaptive filter coefficient $w_f$ is estimated by adaptive filter estimation unit 92.

To estimate the coefficient $w_f$ of the adaptive filter, a reference signal generated by reference signal generator 91 is needed.

Reference signal generator 91 generates a reference signal $r_1[k]$ in active noise control device 50 of a feedforward type, based on the secondary path information $\hat{c}_f$ estimated by secondary path estimation unit 60 and in accordance with equation 15. The reference signal $r_1[k]$ is generated based on the secondary path information $\hat{c}_f$ estimated as an adaptive filter in the echo cancellation and the time-series signal $v_1$ of the noise signal $v_1[k]$ acquired by noise source acquisition unit 80.

$$r_1[k]=\hat{c}_f*\mathbf{v_1} \quad (15)$$

When near-end speaker 12 amplifies and outputs the generated noise cancelling signal under the feedforward type of active noise control, a spatial characteristic (secondary path information) of a sound propagating from near-end speaker 12 to near-end microphone 11 is convolved into the noise cancelling signal. Therefore, a reason for generating the reference signal is that it is necessary to refer to the noise signal reflecting the influence of the secondary path in order to estimate the adaptive filter used under the active noise control.

The noise cancelling signal $\hat{n}'_f[k]$ expressed by equation 14 is observed at the location of near-end microphone 11, as a signal into which the secondary path information $c_f$ is convolved as illustrated in equation 7. Therefore, the error signal after noise cancellation which is actually observed at the location of near-end microphone 11 is expressed by equation 16 as a case where equation 3, 7, and 15 are substituted into equation 10, the incoming echo is ideally cancelled, and a near-end speech signal $s_f[k]$ is absent.

$$e_f[k]=n_f[k]-\hat{n}_f[k]=h_f*v_1-c_f*\hat{n}'_f=h_f*\mathbf{v_1}-\{c_f*(w_f*v_1)\}=\{h_f-c_f*w_f\}*\mathbf{v_1} \quad (16)$$

As can be seen from equation 16, it is possible to achieve clearing of noise when the primary path information $h_f$ equates with the characteristic acquired by convoluting the coefficient $w_f$ of the adaptive filter into the secondary path information $c_f$. In this case, it is considered that the coefficient $w_f$ of the adaptive filter converges on a characteristic into which the inverse filter of the secondary path information $c_f$ and the primary path information $h_f$ are convolved.

In the above case, the secondary path information $c_f$ is a characteristic convolved by being automatically transmitted in space when the near-end speaker 12 reproduces the noise cancelling signal. By changing the order of convolving the second term of the third modified equation in equation 16, the reference signal for use in estimating the coefficient $w_f$ of the adaptive filter that minimizes the error signal in equation 16 can be expressed by equation 17.

$$e_f[k]=h_f*v_1-w_f*\{c_f*v_1\}. \quad (17)$$

In this equation, $c_f*v_1$, which is deformed by convolving the time-series signal $v_1$ of the noise signal $v_1[k]$ acquired by noise source acquisition unit 80 into $c_f$, is referenced. In this way, it is considered that the coefficient $w_f$ of the adaptive filter can be estimated.

The active noise control method, in which the coefficient of the adaptive filter is estimated with the reference signal into which the secondary path information is convolved, is referred to as a filtered-X type of active noise control. This method has been widely used in conventional active noise control device 50. For the filtered-X type of active noise control, the secondary path information $c_f$ used to generate the reference signal $c_f*v_1$ generally needs to be statically measured in advance. However, when the statically measured secondary path information is used, if the transfer characteristic of the secondary path at the time of measurement differs from that at the time of use, expected silencing performance cannot be exhibited, which turns out to be a problem.

In the present disclosure, the secondary path information $\hat{c}_f$ estimated by secondary path estimation unit 60 as an adaptive filter is used as the secondary path information. Then, by generating the reference signal in accordance with equation 15, dynamic path fluctuations can be reflected in active noise control device 50.

By using the reference signal $r_1[k]$ expressed by equation 15 and the error signal $e_f[k]$ expressed by equation 10, adaptive filter estimation unit 92 estimates the coefficient $w_f$ of the adaptive filter used for the active noise control.

To estimate the coefficient $w_f$ of the adaptive filter, following equation 18 for subsequent update is used similar to the adaptive filter in the echo cancellation.

$$w_f^{(k)}=w_f^{(k-1)}+\mu\Delta w_f^{(k)}. \quad (18)$$

In this equation, $w^{(k)}_f$ denotes an adaptive filter estimated at time k. In addition, $w^{(k)}_f$ is updated by adding a value proportional to the adaptive filter update amount $\Delta w_f$ to the adaptive filter one time before. Furthermore, μ is a step parameter for controlling the update amount per update and is generally a value that attenuates according to the tap of the adaptive filter.

Methods of determining $\Delta w_f$ typically include an LMS method, an NLMS method, and a time-domain ICA. In any of the methods, $\Delta w_f$ is acquired by reflecting the spatial noise cancellation amount with the error signal $e_f[k]$ as expressed by equation 19 and referring to the reference signal $r_1[k]$ expressed by equation 15.

$$\Delta w_f^{(k)}[l] = \frac{e_f[k]r_1[k-l]}{N_1[k]}. \quad \text{[Equation 19]}$$

In this equation, l denotes an index representative of an l-th tap in the adaptive filter. In addition, $N_1[k]$ is a norm signal for use in normalizing the update amount. As $N_1[k]$, for example, reference noise signal power in a certain time past from a current time k is used. In equation 19, the error signal $e_f[k]$ is multiplied as it is, but in the time domain ICA, a value non-linearly converted by the sign function or a tanh function is used. Similar to the adaptive filter in the echo canceller, it is thought that an adaptive filter estimation method that uses samples over a plurality of times, such as an affine projection method (APA method) and a recursive least squares method (RLS method), is used.

As described above, noise cancelling signal generator 90 generates the noise cancelling signal $n^{[<]BEGINITALm'}_f[k]$ by convolving coefficient $w_f$ of the learned adaptive filter into the noise signal $v_1$, as expressed by equation 14. Then, near-end speaker 12 reproduces the noise cancelling signal $n^{[<]BEGINITALm}_f[k]$, thereby achieving the noise cancellation, as expressed by equation 10.

[1-4. Limitation of Band of Learning Signal with Band-Limiting Filter (LPF)]

In FIG. 5, low-pass filter (LPF) 921 that controls the band is provided at a downstream stage of both the reference noise signal generated in accordance with equation 15 and the error signal expressed by equation 10, which are supplied to adaptive filter estimation unit 92. If the secondary path information $\hat{c}_f$ estimated by secondary path estimation unit 60 is learned with a full-band signal, the reference signal generated by equation 15 is also a signal containing full-band components.

If band limitation is not performed on the error signal in equation 10 which has not yet been supplied to adaptive filter estimation unit 92, this error signal also contains the full-band signal.

On the other hand, it is considered that a frequency band targeted for the active noise control depends on the type of a signal serving as a noise source. If a noise signal related to engine noise is cancelled, for example, a noise source frequency is determined by a number of revolutions of the engine. Therefore, a noise cancelling signal of up to about 300 Hz may be generated.

If an external microphone is used instead of the engine pulse in order to acquire the reference noise, it is necessary to determine a band to be controlled depending on, for example, a location of an error microphone or a speaker and then to change the control frequency of LPF 921.

When a frequency band to be controlled is predetermined as described above, an active noise control adaptive filter is not learned with a full-band signal but is learned with a learning signal with its band limited. This can limit the pass band of the adaptive filter to be learned.

Noise cancelling signal generator 90 convolves the adaptive filter learned in the above manner into the noise signal. In this way, when actually generating the noise cancelling signal, noise cancelling signal generator 90 can generate the noise cancelling signal without the noise signal being affected by group delay due to the LPF. Adaptive filter estimation unit 92 includes LPF 921 (band-limiting filter). Noise cancelling signal generator 93 uses a signal with its band limited by LPF 921 to generate the noise cancelling signal $\hat{n}'_f[k]$. More specifically, as illustrated in FIG. 5, adaptive filter estimation unit 92 uses LPF 921 to limit the band of the reference signal $r_1[k]$ acquired by convolving the noise signal $v_1$ into the secondary path information $\hat{c}_f$. Noise cancelling signal generator 93 uses a signal with its band limited by LPF 921 to generate the noise cancelling signal $\hat{n}'_f[k]$.

[1-5. Handling Voice Signal Contained in Error Signal]

In the update equation of the echo canceller adaptive filter expressed by equation 13 and the update equation of the active filter for active noise control expressed by equation 19, the error signal expressed by equation 10 which appears in the numerator approaches zero if the voice signal $s_f[k]$ is absent. More specifically, if each adaptive filter is ideally learned, the error signal approaches zero because the incoming echo and the incoming noise are cancelled. As a result, the update amounts of equations 13 and 19 approach zero in a zone where $s_f[k]$ is absent.

If the audio signal $s_f[k]$ contained in equation 10 is present, the update amounts in equation 13 and equation 19 do not become zero, and the error amount does not approach zero. As a result, double talk that may incorrectly modify the coefficient of the adaptive filter occurs. To avoid this double talk, it is necessary to provide a double talk detector (DTD) to detect a zone where $s_f[k]$ is absent or to use an update rule (time domain ICA, etc.) that enables learning even in the double talk state.

[1-6. Effect of Convergence State of Adaptive Filter of Echo Cancellation Device Upon Adaptive Filter of Active Noise Control Device]

As described in [1-5], if the error signal contains a signal that may incorrectly modify the adaptive filter during learning, the update of the coefficient of the adaptive filter is affected. If the second term on the right side of the left-side equation in equation 10 is not zero, a similar phenomenon occurs. The above case corresponds to a case where the adaptive filter of echo cancellation device 40 insufficiently converges and thus has not achieved the cancellation of the incoming echo or a case where the third term is not zero, that is, the adaptive filter of active noise control device 50 insufficiently converges and thus has not achieved the cancellation of the incoming echo.

Active noise control device 50 regards the coefficient of the adaptive filter in echo cancellation device 40 as the secondary path information and deals with a dynamic path. Therefore, the operation of active noise control device 50 depends on the convergent state of the adaptive filter of echo cancellation device 40. If the adaptive filter of echo cancellation device 40 does not converge, the reference noise signal calculated by equation 15 is not calculated correctly, and the echo cancellation residual signal in the error signal influences the update of the adaptive filter. Therefore, it is considered that the learning of the adaptive filter in active noise control device 50 needs to reflect the learning state of the adaptive filter of echo cancellation device 40.

In a method of grasping the learning state of the adaptive filter of echo cancellation device 40, it is considered that an input/output level ratio of the echo cancellation device is calculated in a zone of a single talk. In this case, the zone of the single talk refers to a zone in which the near-end speech $s_f[k]$ is absent in equation 1.

To detect the zone in which the near-end voice $s_f[k]$ is absent, a double talk detector (DTD) is provided between near-end microphone 11 and near-end speaker 12.

The DTD is a device that monitors a near-end microphone signal and a near-end speaker signal and then detects a single talk zone and a double talk zone, based on the average signal levels and maximum peak levels of the near-end microphone signal and the near-end speaker signal. In this case, the double talk zone refers to a zone in which the near-end voice $s_f[k]$ and the echo signal $d_f[k]$ are simultaneously present.

When not detecting the double talk zone but detecting the single talk zone, the DTD calculates the input/output signal level ratio of echo cancellation device 40.

An input signal supplied to echo cancellation device 40 is a signal acquired by adding the echo signal $d_f[k]$ and the noise signal $n_f[k]$. An output signal is a signal acquired by adding an echo cancelled signal $(d_f[k]-\hat{d}_f[k])$ and the noise signal $n_f[k]$. Therefore, the level ratio is equal to $\{(d_f[k]-\hat{d}_f[k])+n_f[k]\}/\{d_f[k]+n_f[k]\}$. Since the cancellation echo signal $\hat{d}_f[k]$ is zero in a state where the echo canceller does not converge, this ratio is close to one.

On the other hand, when the adaptive filter ideally converges, the first term of the numerator approaches a value close to zero, and thus the ratio becomes a value smaller than one.

By calculating the input/output ratio of echo cancellation device 40, the degree of convergence of the adaptive filter in echo cancellation device 40 can be determined.

Each of the input and output signals does not have to be an instantaneous value; however, the input and output signals may be average signal levels over a certain period of time or ratios based on respective signal norms calculated by other appropriate means.

If the update of the adaptive filter of active noise control device 50 is controlled based on the signal level ratio calculated by the above means, it is considered that the adaptive filter of active noise control device 50 is learned, for example, only when the signal level ratio is less than an appropriately preset threshold value. Alternatively, it is considered that the adaptive filter of active noise control device 50 continues to be learned, but when the signal level ratio is less than the threshold value, a step size in the learning is increased.

If an approximate convergence point of the adaptive filter amplitude is known in advance by measurement, for example, another method of grasping the learning state of echo cancellation device 40 is to monitor a peak maximum value of the amplitude of the adaptive filter of echo cancellation device 40. Then, it is also considered that the learning of the adaptive filter on a side of active noise control device 50 is controlled when the signal level ratio exceeds the predetermined threshold.

It should be noted that similar problems occur in the adaptive filter learning on a side of echo cancellation device 40 when the adaptive filter on the side of active noise control device 50 does not converge.

Figure 6:
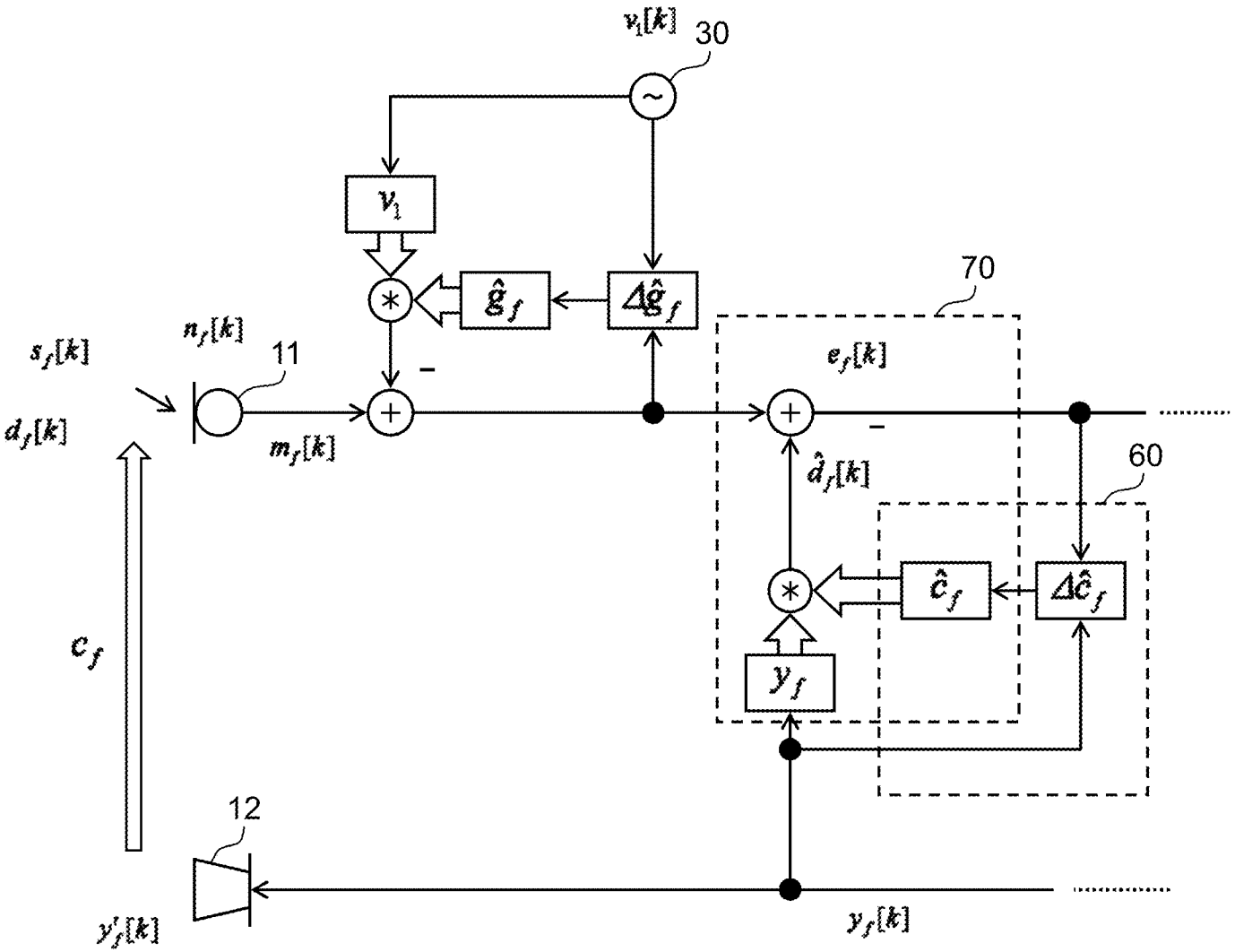
FIG. 6 is a block diagram illustrating a configuration in which noise in an input signal is cancelled by a noise source signal acquired by using a noise source acquisition unit at an upstream stage of the echo cancellation device included in the conversation support device.

For a method of solving this problem, it is considered that an update rule is used as an update rule of the adaptive filter of echo cancellation device 40, so that learning is possible even in a state where noise is superimposed on the main signal. Alternatively, as illustrated in FIG. 6, the noise signal acquired by noise source acquisition unit 80 is referenced before the near-end audio signal is supplied to echo cancellation device 40. Then, a configuration can be considered, in which an adaptive filter gf for use in adaptively clearing noise is estimated with the noise signal and a microphone signal, and a noise removing unit that adaptively subtracts noise components on the line is provided.

The noise removing unit serves as a block that electrically erases the noise components and is matched with the effect of spatial noise cancellation by active noise control device 50. Therefore, a method can be considered, in which the block operates only until the adaptive filter in echo cancellation device 40 becomes stable and then stops. The stabilization of the adaptive filter can be determined by using the input/output level ratio of the echo cancellation device.

As described above, adaptive filter estimation unit 92 operates in cooperation with secondary path estimation unit 60. More specifically, adaptive filter estimation unit 92 calculates the coefficient $w_f$ of the adaptive filter, after secondary path estimation unit 60 has completely calculated the transfer characteristic of the secondary path (secondary path information $\hat{c}_f$).

Second Exemplary Embodiment

Figure 7:
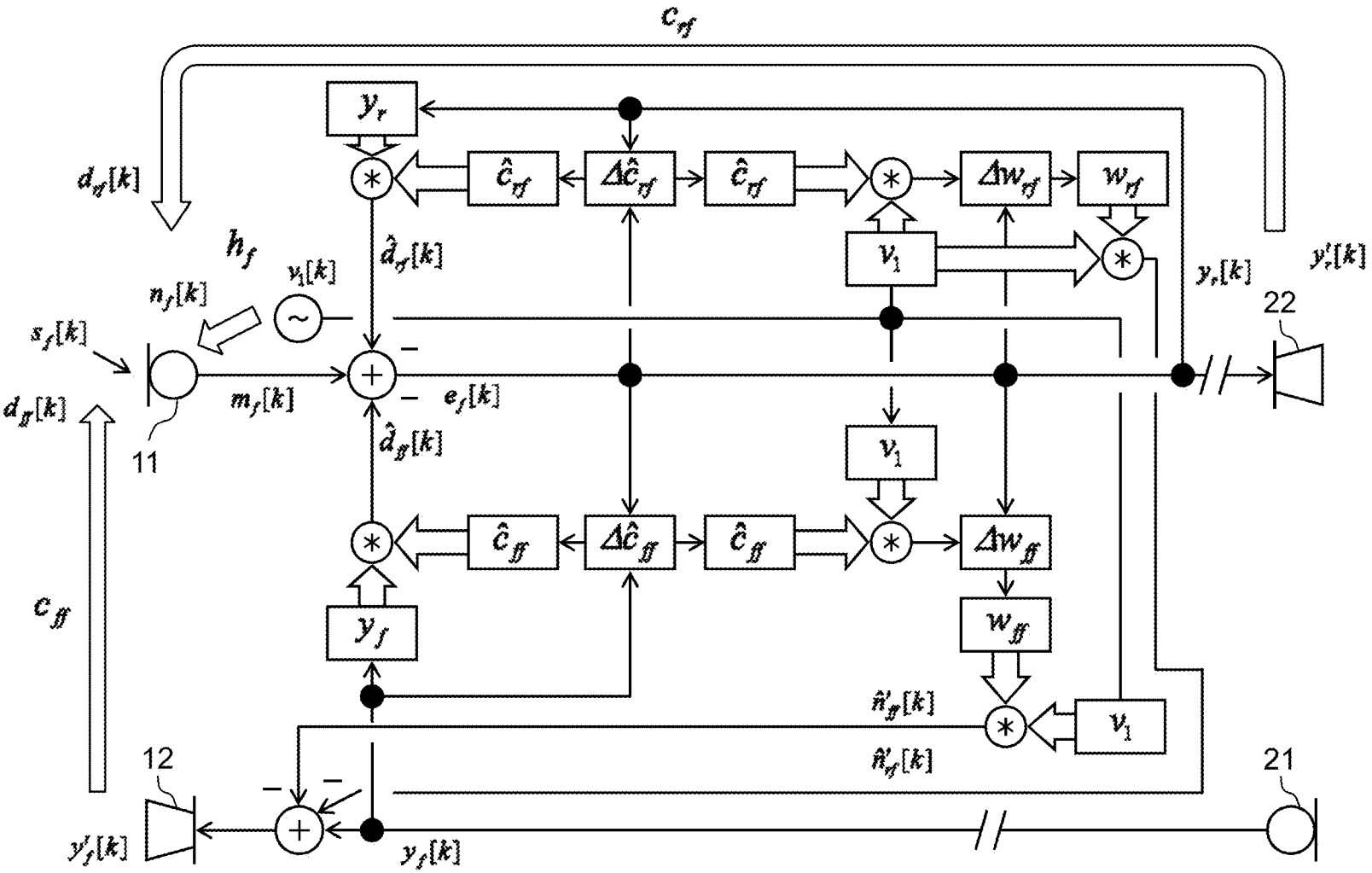
FIG. 7 is a block diagram of a configuration of a conversation support device according to a second exemplary embodiment.

With reference to FIG. 7, a process in conversation support device 1 according to a second exemplary embodiment will be described below.

[2-1. Active Noise Control Device Using Far-End Speaker]

FIG. 7 is a block diagram illustrating a configuration of a conversation support device 1 according to the second exemplary embodiment.

In FIG. 7, to distinguish from the symbols in echo cancellation unit 70, the subscripts of the symbol are arranged in order at a location of a source speaker (near end: f, far end: r) and at a location of a destination microphone position (near end: f, far end: r).

For example, a feedback characteristic from far-end speaker 22 to near-end microphone 11 is denoted by $c_{rf}$, and a feedback signal is denoted by $d_{rf}[k]$.

An adaptive filter used for active noise control related to a transfer characteristic uses the same subscripts as the corresponding secondary path.

Although FIG. 7 illustrates only the configuration related to near-end microphone 11, a similar block configuration can also be employed even when a side of far-end microphone 21 is focused.

Conversation support device 1 causes a problem that, after a voice picked up by near-end microphone 11 is reproduced by far-end speaker 22, the amplified voice is spatially transmitted to near-end microphone 11 as the feedback signal $d_{rf}[k]$. To clear the feedback signal $d_{rf}[k]$, conversation support device 1 includes adaptive filter estimation unit 92 to estimate a feedback characteristic $c_{rf}$. Furthermore, conversation support device 1 includes a feedback clearing unit (not illustrated) that generates a pseudo feedback signal $\hat{d}_{rf}[k]$ by using an adaptive filter estimated by adaptive filter estimation unit 92 and subtracts the pseudo feedback signal $\hat{d}_{rf}[k]$ from a microphone input signal, thereby clearing the feedback signal.

In the second exemplary embodiment, the feedback characteristic is regarded as a secondary path under active noise control. As a result, the active noise control using far-end speaker 22 is performed with the same configuration as active noise control device 50 using near-end speaker 12 in the first exemplary embodiment.

A microphone (input) signal $m_f[k]$ in FIG. 7 is expressed by equation 20 as a sum of a near-end input voice $s_f[k]$, an echo signal $d_{ff}[k]$ coming from near-end speaker 12, the incoming feedback signal $d_{rf}[k]$, and an incoming noise signals $n_f[k]$ that is transmitted from $v_1[k]$ denoting noise and propagates through primary path information $h_f$.

$$m_f[k]=s_f[k]+d_{ff}[k]+d_{rf}[k]+n_f[k] \tag{20}$$

To clear the incoming echo signal from the microphone signal, an error signal $e_f[k]$ is calculated by subtracting a pseudo echo signal $\hat{d}_{ff}[k]$ and a pseudo feedback signal $\hat{d}_{rf}[k]$ from the microphone signal $m_f[k]$ in equation 20 (equation 21). In this case, the pseudo echo signal $\hat{d}_{ff}[k]$ is estimated by convolving a near-end speaker signal $y_f[k]$ into secondary path information $\hat{c}_{ff}$ in which the transfer characteristic of an incoming echo signal is estimated as an adaptive filter. In addition, the pseudo feedback signal $\hat{d}_{rf}[k]$ is estimated by convolving a far-end speaker signal $y_r[k]$ into secondary path information $\hat{c}_{rf}$ in which a transfer characteristic of an incoming feedback signal is estimated as an adaptive filter.

$$e_f[k]=s_f[k]+(d_{ff}[k]-\hat{d}_{ff}[k])+(d_{rf}[k]-\hat{d}_{rf}[k])+n_f[k] \tag{21}$$

To estimate the echo transfer characteristic $c_{ff}$, the error signal $e_f[k]$ is supplied to secondary path estimation unit 60 related to the echo transfer characteristic together with a near-end speaker signal. Likewise, to estimate the feedback transfer characteristic $c_{rf}$, the error signal $e_f[k]$ is supplied to secondary path estimation unit 60 related to the feedback transfer characteristic together with a far-end speaker signal. Secondary path information $\hat{c}_{ff}$ and secondary path information $\hat{c}_{rf}$ estimated as adaptive filters by secondary path estimation unit 60 are convolved into $v_1$ which represents the noise signal $v_1[k]$ acquired from noise source 30 as a time-series signal and are thereby supplied to adaptive filter estimation unit 92 under the active noise control, together with the error signal. Then, coefficients $w_{ff}$ and $w_{rf}$ of the adaptive filter estimated by adaptive filter estimation unit 92 under the active noise control are convoluted into the noise source signal vector $v_1$, so that noise cancelling signals $\hat{n}'_{ff}[k]$ and $\hat{n}'_{rf}[k]$ under the active noise control are generated.

The noise cancelling signal $\hat{n}'_{ff}[k]$ is subtracted from the near-end speaker signal, and $\hat{n}'_{rf}[k]$ is subtracted from the far-end speaker signal. In this way, final speaker playback signals $y'_f[k]$ and $y'_r[k]$ are generated. The noise cancelling signals $\hat{n}'_{ff}[k]$ and $\hat{n}'_{rf}[k]$ contained in the speaker reproduction signals $y'_f[k]$ and $y'_r[k]$ are transmitted through the secondary path information $c_{ff}$ and the secondary path information $c_{rf}$ and turn out to be cancellation noises $\hat{n}_{ff}[k]$ and $\hat{n}_{rf}[k]$.

The microphone signal that has been expressed by equation 20 is also expressed by equation 22 under the active noise control.

$$m_f[k]=s_f[k]+d_{ff}[k]+d_{rf}[k]+(n_f[k]-\hat{n}_{ff}[k]-\hat{n}_{rf}[k]) \tag{22}$$

The incoming noise $n_f[k]$ supplied to the error microphone is cleared when the incoming noise $n_f[k]$ equates with a sum of the cancellation noises $\hat{n}_{ff}[k]$ and $\hat{n}_{rf}[k]$ under the active noise control.

The error signal in equation 21 is also expressed by equation 23.

$$e_f[k]=s_f[k]+(d_{ff}[k]-\hat{d}_{ff}[k])+(d_{rf}[k]-\hat{d}_{rf}[k])+(n_f[k]-\hat{n}_{ff}[k]-\hat{n}_{rf}[k]) \tag{23}$$

Equation 23 permits only the microphone signal on the near-end to pass when echo cancellation, feedback cancellation, and noise cancellation are ideally achieved.

FIG. 7 illustrates the parallel configuration in which the incoming echo signal and the incoming feedback signal are simultaneously cleared and the error signal is used for the learning of the adaptive filter. However, a series configuration may be employed, in which the secondary path information $\hat{c}_{ff}$ used as an adaptive filter is learned by using the error signal from which only the incoming echo signal is cleared and in which the error signal from which the incoming feedback signal is further cleared is used to learn the secondary path information $\hat{c}_{rf}$ as the adaptive filter.

The present configuration can achieve the active noise control using only the feedback characteristic as the secondary path information even in the assumption that far-end microphone 21 is absent and thus one-way conversation support is performed from the front to the rear. More specifically, even if only the feedback signal from far-end speaker 22 to near-end microphone 11 enters near-end microphone 11, the active noise control can be performed.

A conceivable example of the second exemplary embodiment is a case where a conversation support device uses a door speaker on a second row in a vehicle as far-end speaker 22 and achieves the active noise control by using far-end speaker 22.

Example of Installation

[3-1. Installation Locations of Microphone and Speaker]

Near-end microphone 11 according to the present disclosure serves both as a sound pickup microphone for voice speeches and as an error microphone in active noise control device 50. Therefore, the installation location is preferably near a talker's mouth and strongly required to be adjacent to a location of a talker's ear.

Figure 8:
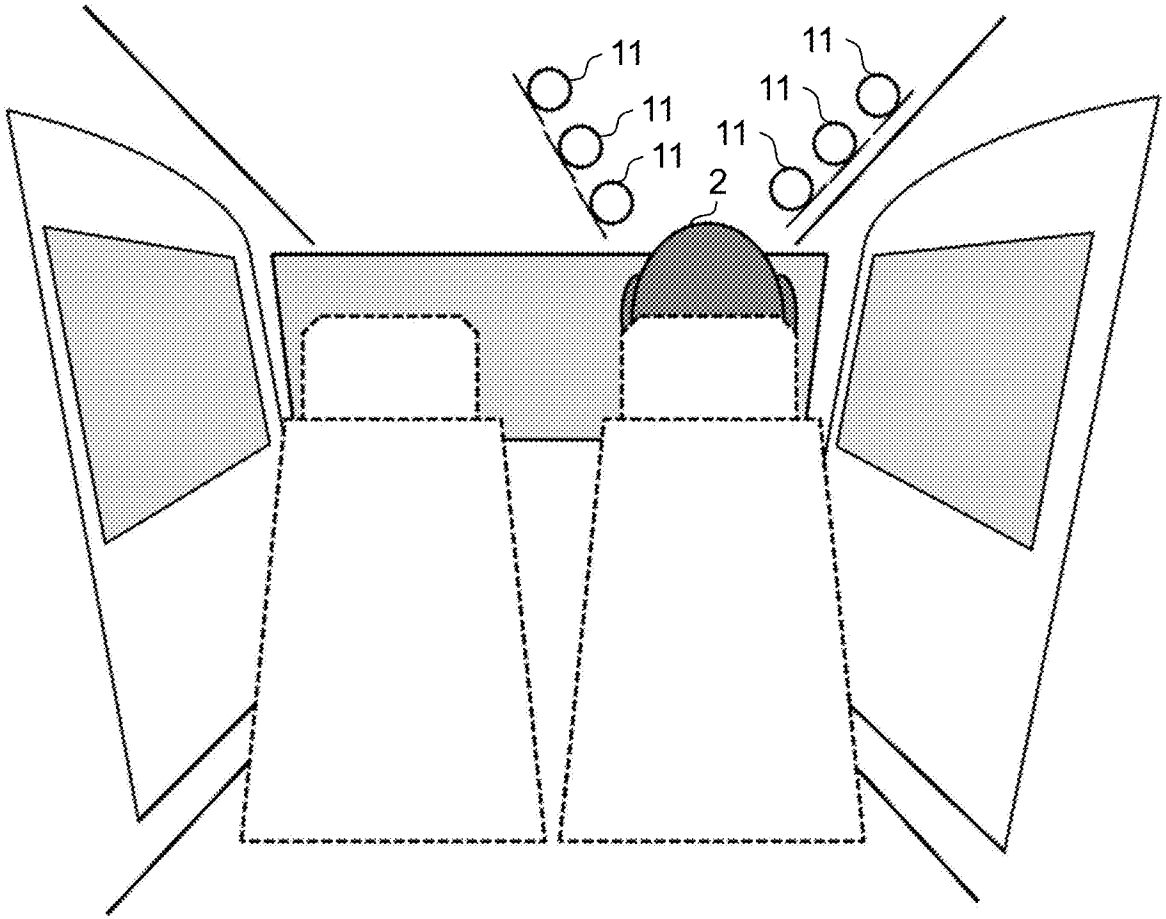
FIG. 8 is an external view illustrating an example of locations at which microphones of the conversation support device according to the present disclosure are disposed.

FIG. 8 illustrates an example of installation locations of microphones. In FIG. 8, near-end microphones 11 are installed above the seat or above the side surface. One conceivable example of installation other than that illustrated in FIG. 8 is a configuration in which a microphone is embedded in the headrest. It is necessary to determine an actual installation location of a microphone, depending on a frequency band to be controlled by active noise control device 50. This is because the higher the frequency, the shorter the wavelength, and the longer the distance from the ear to the microphone, the lower the controllable frequency.

Instead of using a single microphone, a microphone array that uses a plurality of microphones as an array configuration may be used, as illustrated in FIG. 8. One reason for using the microphone array is to pick up only sounds present in a direction toward a talker with a high signal-noise (SN) ratio by performing directional synthesis and to perform active noise control using multiple error microphones, thereby improving a silencing performance near the ears. In this case, it is necessary to remove echo signals from the respective microphones of the microphone array in anticipation of the directivity synthesis or active noise control device 50. Therefore, it is necessary to provide a plurality of echo cancellation devices 40 and echo cancellation units 70 in relation to the respective microphones. Moreover, regarding the active noise control device, it is necessary to provide active noise control devices 50 and noise cancelling signal generators 90 in relation to the respective microphones.

Active noise control devices 50 may be provided only for microphones present within an area to be controlled. Noise cancelling signals generated by active noise control devices 50 are added to a near-end speaker signal.

In terms of echo cancellation, the speaker is more preferably installed at a location farther from near-end microphone 11 because an acoustic coupling amount on the near-end increases. However, in terms of active noise control, the location is more preferably closer to the near-end error microphone because the noise cancellation signal is radiated with a low spatial delay. This is because it is necessary to generate a noise cancellation signal and radiate the noise cancellation signal from the speaker after a noise signal is detected and until the noise spatially reaches the control region. For this reason, the speaker is preferably installed at a location maximally close to near-end microphone 11 unless the echo cancellation operation is hindered.

Summary 1 of Exemplary Embodiment

As illustrated in FIGS. 2 and 5, conversation support device 1 according to an aspect of the present disclosure includes: near-end speaker 12; near-end microphone 11; noise source acquisition unit 80; secondary path estimation unit 60 (an example of a first calculator); echo cancellation unit 70; adaptive filter estimation unit 92 (an example of a second calculator); and noise cancelling signal generator 93 (an example of an active noise cancellation controller).

Noise source acquisition unit 80 acquires a noise signal $v_1$ representative of noise of noise source 30. Secondary path estimation unit 60 calculates a transfer characteristic (secondary path information $\hat{c}_f$) of a secondary path between near-end speaker 12 and near-end microphone 11. Echo cancellation unit 70 cancels an echo from near-end speaker 12 to near-end microphone 11 by using the secondary path information $\hat{c}_f$ (refer to equations 5 and 9). Adaptive filter estimation unit 92 calculates a coefficient $w_f$ of an adaptive filter, based on the secondary path information $\hat{c}_f$ and the noise signal $v_1$ (refer to equations 15, 18, and 19). Noise cancelling signal generator 93 generates a noise cancelling signal $\hat{n}'_f[k]$ that controls cancellation of the noise by using the coefficient $w_f$ of the adaptive filter and the noise signal $v_1$ (refer to equation 14).

Summary 2 of Exemplary Embodiment

Figure 9:
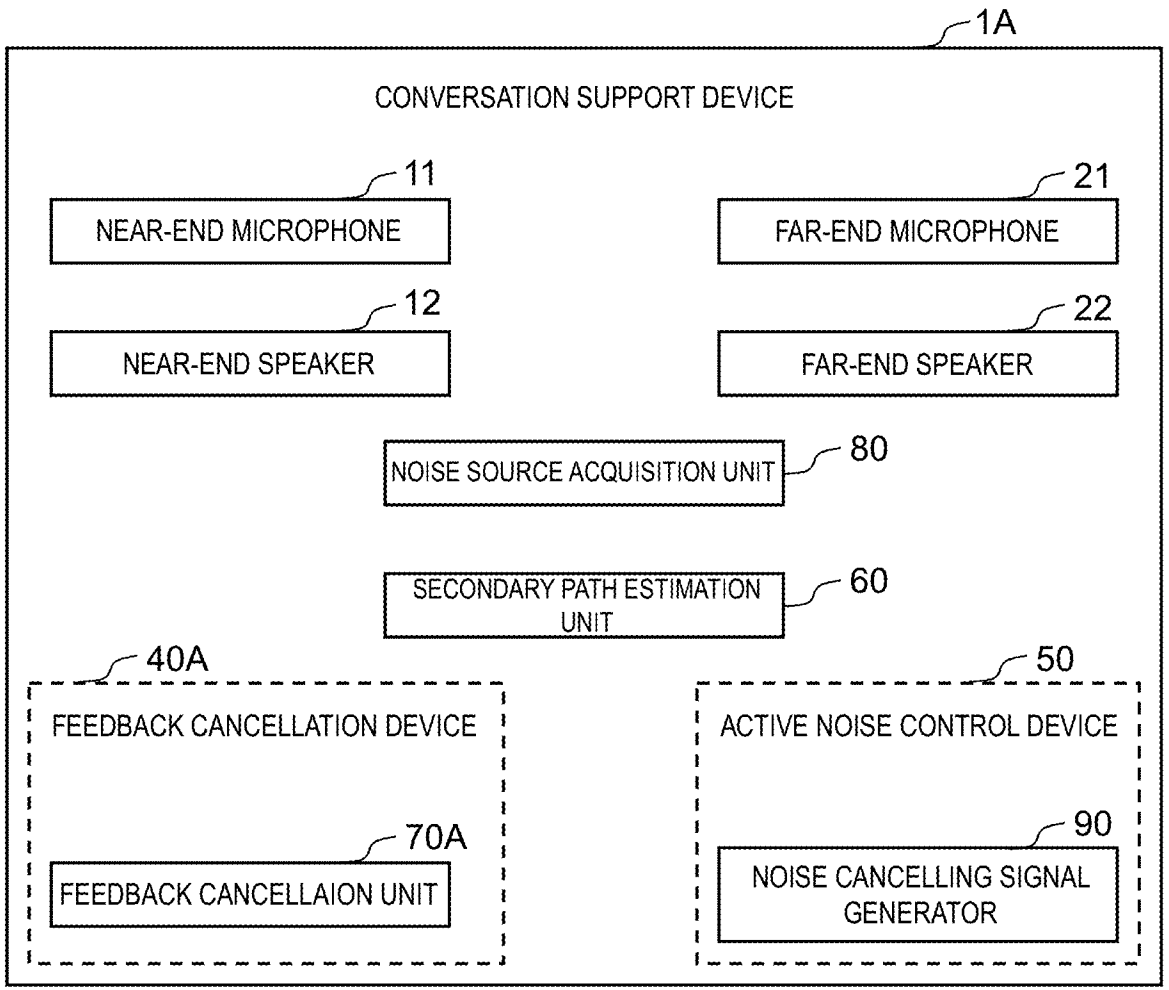
FIG. 9 is a configuration diagram illustrating a configuration of a conversation support device according to another aspect of the present disclosure.

As illustrated in FIG. 9, conversation support device 1A according to another aspect of the present disclosure includes feedback cancellation device 40A instead of echo cancellation device 40 of conversation assistance device 1. Feedback cancellation device 40A includes feedback cancellation unit 70A.

In the present aspect, secondary path estimation unit 60 calculates, for example, a transfer characteristic of a secondary path between far-end speaker 22 and near-end microphone 11. Feedback cancellation unit 70A cancels feedback from far-end speaker 22 to near-end microphone 11 by using the transfer characteristic of the secondary path.

In the above way, conversation support device 1A according to the present aspect can cancel feedback and noise at a location of near-end microphone 11 by using the transfer characteristic of the secondary path. The feedback that conversation support device 1A can cancel is not limited to the feedback from far-end speaker 22 to near-end microphone 11. Conversation support device 1A can also cancel feedback from near-end speaker 12 to far-end microphone 21 by calculating a secondary path between near-end speaker 12 and far-end microphone 21.

Summary 3 of Exemplary Embodiment

Figure 10:
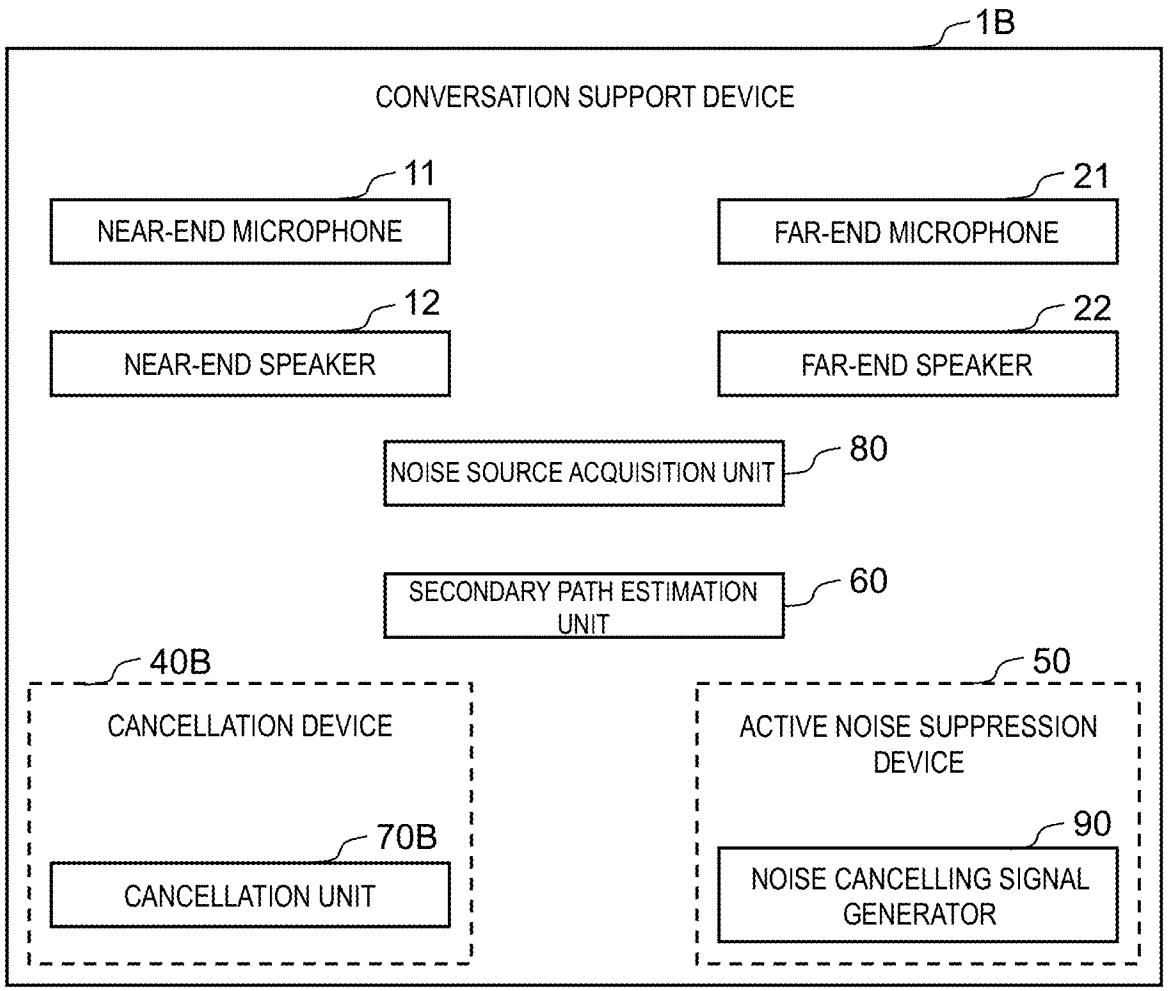
FIG. 10 is a configuration diagram illustrating a configuration of a conversation support device according to further another aspect of the present disclosure.

As illustrated in FIG. 10, conversation support device 1B according to further another aspect of the present disclosure includes cancellation device 40B instead of echo cancellation device 40 of conversation support device 1. Cancellation device 40B includes cancellation unit 70B.

Secondary path estimation unit 60 calculates a transfer characteristic $\hat{c}_{ff}$ of a secondary path (first secondary path) between near-end speaker 12 and near-end microphone 11 and also calculates a transfer characteristic $\hat{c}_{rf}$ of a secondary path (second secondary path) between far-end speaker 22 and near-end microphone 11. Cancellation unit 70B cancels an echo reaching near-end microphone 11 by using the transfer characteristic $\hat{c}_{ff}$ of the first secondary path and also cancels feedback reaching near-end microphone 11 by using the transfer characteristic $\hat{c}_{rf}$ of the second secondary path. Adaptive filter estimation unit 92 calculates a coefficient $w_{ff}$ of a first adaptive filter, based on the transfer characteristic $\hat{c}_{ff}$ of the first secondary path and a noise signal $v_1$ and also calculates a coefficient $w_{rf}$ of a second adaptive filter, based on the transfer characteristic $\hat{c}_{rf}$ of the second secondary path and the noise signal $v_1$. Noise cancelling signal generator 93 generates a first noise cancelling signal $\hat{n}'_{ff}[k]$ that controls cancellation of the noise by using the coefficient $w_{ff}$ of the first adaptive filter and the noise signal $v_1$ and also generates a second noise cancelling signal $\hat{n}'_{rf}[k]$ that controls cancellation of the noise by using the coefficient $w_{rf}$ of the second adaptive filter and the noise signal $v_1$.

With the above, conversation support device 1B according to the present aspect can further cancel noise at a location of near-end microphone 11 by using the first and second noise cancelling signals $\hat{n}'_{ff}[k]$ and $\hat{n}'_{rf}[k]$. The example that involves using near-end microphone 11 has been described above; however, conversation support device 1B can also cancel noise at a location of far-end microphone 21 by using far-end microphone 21.

Since the above exemplary embodiment is intended to describe examples of the technique in the present disclosure and thus can undergo various modifications, replacements, additions, and removals, for example, without departing from the scopes of the accompanying claims and their equivalents.

INDUSTRIAL APPLICABILITY

The present disclosure is applicable to conversation support devices that cancel noise at a talker's location in an environment where noise that interferes with a voice to be listened to is generated. More specifically, the present disclosure is applicable to vehicles such as automobiles, airplanes, trains, and ships.

REFERENCE MARKS IN THE DRAWINGS

1, 1A, 1B conversation support device
2 near-end talker
3 far-end talker
11 near-end microphone
12 near-end speaker
21 far-end microphone
22 far-end speaker
30 noise source
40 echo cancellation device
50 active noise control device
60 secondary path estimation unit
70 echo cancellation unit
80 noise source acquisition unit
90 noise cancelling signal generator
91 reference signal generator
92 adaptive filter estimation unit
93 noise cancelling signal generator

The invention claimed is:

1. A conversation support device comprising:
a speaker;
a microphone electrically connected to the speaker;
a noise source acquisition unit that acquires a noise signal indicating noise;
a first calculator that calculates a transfer characteristic of a secondary path between the speaker and the microphone, wherein the transfer characteristic of the secondary path that is calculated by the first calculator is secondary path information that is estimated as an adaptive filter by a sequential update formula;
a feedback cancellation unit that cancels an incoming feedback signal by using the secondary path information;
a second calculator that calculates a coefficient of an adaptive filter, based on the secondary path information, the noise signal, and a feedback-cancelled signal in which the incoming feedback signal has been cancelled; and
an active noise cancellation controller that generates a noise cancelling signal by using the coefficient of the adaptive filter and the noise signal, the noise cancelling signal being for controlling cancellation of the noise.

2. The conversation support device according to claim 1, wherein the conversation support device is provided in a vehicle.

3. The conversation support device according to claim 2, wherein the microphone is disposed near a seat in the vehicle.

4. The conversation support device according to claim 1, wherein the sequential update formula is shown by the following equation $$\hat{c}_f^{(k)}=\hat{c}_f^{(k-1)})+\mu\Delta\hat{c}_f^{(k)}$$

wherein the secondary path information is an adaptive filter estimated at time k and the secondary path information is updated by adding a value proportional to an adaptive filter update amount $\Delta\hat{c}f$ to the adaptive filter one time before, and $\mu$ is a step parameter for use in controlling an update amount for each update.

5. A conversation support device comprising:
a first speaker;
a second speaker;
a microphone electrically connected to the second speaker;
a noise source acquisition unit that acquires a noise signal indicating noise,
a first calculator that calculates a transfer characteristic of a first secondary path between the first speaker and the microphone and a transfer characteristic of a second secondary path between the second speaker and the microphone, wherein the transfer characteristic of the first secondary path that is calculated by the first calculator is first secondary path information that is estimated as an adaptive filter by a sequential update formula and the transfer characteristic of the second secondary path that is calculated by the first calculator is second secondary path information that is estimated as an adaptive filter by the sequential update formula;
a cancellation unit that cancels an incoming echo signal reaching the microphone by using the first secondary path information and that cancels an incoming feedback signal reaching the microphone by using the second secondary path information;
a second calculator that calculates a coefficient of a first adaptive filter, based on the first secondary path information, the noise signal, and an echo-cancelled signal in which the incoming echo signal has been cancelled and that calculates a coefficient of a second adaptive filter, based on the second secondary path information, the noise signal, and a feedback-cancelled signal in which the incoming feedback signal has been cancelled; and
an active noise cancellation controller that:
generates a first noise cancelling signal by using the coefficient of the first adaptive filter and the noise signal, the first noise cancelling signal being for controlling cancellation of the noise, and generates a second noise cancelling signal by using the coefficient of the second adaptive filter and the noise signal, the second noise cancelling signal being for controlling cancellation of the noise.

6. The conversation support device according to claim 5, wherein the conversation support device is provided in a vehicle.

7. The conversation support device according to claim 6, wherein the microphone is disposed near a seat in the vehicle.

8. The conversation support device according to claim 5, wherein the sequential update formula is shown by the following equation $$\hat{c}_f^{(k)}=\hat{c}_f^{(k-1)}+\mu\Delta\hat{c}_f^{(k)}$$

wherein each of the first secondary path information and the second secondary path information is an adaptive filter estimated at time k and each of the first secondary path information and the second secondary path information is updated by adding a value proportional to an adaptive filter update amount Δc^f to the adaptive filter one time before, and μ is a step parameter for use in controlling an update amount for each update.

* * * * *